US009057160B2

(12) United States Patent
Scott

(10) Patent No.: US 9,057,160 B2
(45) Date of Patent: Jun. 16, 2015

(54) SELF-CONTAINED TRIATHLON COMPLEX

(71) Applicant: William Scott, Wilmington, NC (US)

(72) Inventor: William Scott, Wilmington, NC (US)

(73) Assignee: Trihabitat, LLC, Wilmington, NC (US)

( * ) Notice: Subject to any disclaimer, the term of this patent is extended or adjusted under 35 U.S.C. 154(b) by 28 days.

(21) Appl. No.: 14/055,026

(22) Filed: Oct. 16, 2013

(65) Prior Publication Data

US 2014/0228138 A1 Aug. 14, 2014

Related U.S. Application Data

(60) Provisional application No. 61/719,996, filed on Oct. 30, 2012.

(51) Int. Cl.

| | |
|---|---|
| ***A63C 19/00*** | (2006.01) |
| ***E01C 1/00*** | (2006.01) |
| *E01C 13/00* | (2006.01) |

(52) U.S. Cl.

CPC ..... *E01C 1/002* (2013.01)

(58) Field of Classification Search

CPC ..... E01C 2013/006; A63C 19/00; A63K 1/00
USPC ..... 472/85–87, 92, 94, 136; 52/6, 8
See application file for complete search history.

(56) References Cited

U.S. PATENT DOCUMENTS

| | | | | |
|---|---|---|---|---|
| 6,692,367 | B1 | 2/2004 | Duran | |
| 6,699,137 | B2 | 3/2004 | Szymanski | |
| 6,722,995 | B1 | 4/2004 | Albers | |
| 6,832,452 | B1 * | 12/2004 | Simens | 52/6 |
| 7,357,727 | B2 | 4/2008 | Back | |
| 7,591,731 | B2 | 9/2009 | Carroll | |
| 7,648,420 | B2 | 1/2010 | Stroppiana | |
| 7,651,404 | B1 | 1/2010 | Larson | |
| 7,887,442 | B2 | 2/2011 | Van Huystee | |
| 2005/0107172 | A1 * | 5/2005 | Morell | 472/92 |
| 2006/0105847 | A1 * | 5/2006 | Stroppiana | 472/85 |

* cited by examiner

*Primary Examiner* — Kien Nguyen
(74) *Attorney, Agent, or Firm* — MacCord Mason PLLC

(57) ABSTRACT

A self-contained, controlled access, triathlon complex is described that includes a dedicated artificial body of water having a swimming starting point and a swimming finish point; dedicated biking roadway having a biking starting point adjacent the swimming finish point, and a biking finish point; a dedicated running path having a running starting point adjacent the biking finish point, and a running finish point; and an access limiting boundary surrounding the body of water, biking roadway and running path, the boundary including at least one gate for allowing controlled access to the complex.

13 Claims, 3 Drawing Sheets

SELF-CONTAINED TRIATHLON COMPLEX

This application claims the benefit of the filing data of U.S. Provisional Patent Application No. 61/719,996, filed Oct. 30, 2012, incorporated herein by reference in its entirety.

BACKGROUND OF THE INVENTION (1) Field of the Invention

The present invention relates generally to a totally integrated triathlon complex including a lake for swimming events, a bike course, a running track, transition areas, spectator seating areas, and related facilities.

(2) Description of the Prior Art

A triathlon in its most popular form involves swimming, cycling, and running events in immediate succession over various distances with transitions between swimming/cycling and cycling/running. The triathletes compete for fastest overall course completion time, including timed transitions.

Triathlons are conducted over different distances. A Sprint triathlon is a 0.47 mile (750 meter) swim, a 12 mile (20 kilometer) bike ride, and a 3.1 mile (5 kilometer) run. A Standard or "Olympic distance" triathlon is a 0.93 mile (1.5 kilometer) swim, a 25 mile (40 kilometer) bike ride, and a 6.2 mile (10 kilometer) run. The Long Course triathlon is a 1.2 mile (1.9 kilometer) swim, a 56 mile (90 kilometer) bike ride, and a 13.1 mile (21.1 km) run. Finally, the Ultra Distance triathlon is a 2.4 mile (3.9 kilometer) swim, a 112 mile (180 kilometer) bike ride, and a 26.2 mile (42.2 kilometer) run.

Venues suitable for triathlon events, particularly the longer events, are extremely limited. A body of water, e.g., a lake, bay, Intracoastal waterway, river, ocean, etc., must be available that is safe for the triathletes to swim, as well as enter and exit. The bike and running courses must be designed using existing roadways, which are less than optimal for racing, since the bike and running courses must follow existing roadways. In addition, permission of various authorities, including the Department of Transportation, and local law enforcement and municipalities, is required. Use of public roadways results in traffic delays and changed traffic patterns, often resulting in complaints by the public. There is also an inherent risk of injury to participants from vehicles when using pubic roadways.

In addition to finding suitable locations and courses for the swimming, bike and running events, a triathlon requires location of these courses in close proximity to each other so that the triathletes can transition from one stage to the other. Also, each event requires the availability of a transition area between the swim and bike venues and the bike and running venues. Obviously, triathlons locations meeting all of these requirements are limited, particularly in urban areas, thereby limiting these events.

Triathlons, while popular with contestants, have relatively limited spectator participation compared to other sports since there are few viewing areas where the spectators can view significant segments of the event. Viewers also tend to congregate along swimming, biking or running areas on public land or in other areas that are not controlled by the triathlon operator. Vending opportunities are also limited.

SUMMARY OF THE INVENTION

The present invention addresses the need by providing a permanent, fully integrated triathlon complex that includes a body of water for swimming, a dedicated roadway for biking and a dedicated path for running, all specifically designed and sized for triathlon events and proximate to each other. The term "dedicated" meaning the roadway and path are only used for triathlons and related activities, such as training for triathlons. In addition, the stadium includes a transition area between the body of water and the start of the biking roadway, and the finish of the biking roadway and the start of the running pathway.

The triathlon stadium includes other facilities and options to add to the enjoyment and convenience of the triathlon event. In particular, permanent viewing stadiums or seating are provided so that spectators can view the event in comfort. Other facilities and options include timing and scoring systems, high tech audio and video systems, seating for viewers, preferably PGA type raised earth mounds adjacent the event areas, light towers for nighttime racing, etc.

The triathlon complex is surrounded by a boundary, e.g., a fence, preventing access to the facility except through gates staffed by the operator. Thus, the operator is able to control access to the event and charge admission. Close in viewer parking is also provided convenient the entry gate.

The complex may also include other facilities not normally available with triathlon events. These facilities include lodging for the triathletes and spectators, a conference center, a motorhome park, a pavilion for post-event activities, an amphitheater. Such facilities not only contribute to the enjoyment of the event, but also provide revenue streams to the event sponsor.

The self-contained triathlon complex provides several improvements over triathlons as they are currently conducted. Approvals of regulatory and municipal authorities are no longer required. Hiring of police to control traffic is unnecessary. The public, instead of complaining about the effects on traffic, is supportive of the new recreational opportunity. From the triathletes' viewpoint, the event areas are optimally designed for the sport as opposed to "making the best with what's available" currently used.

In addition, an integrated triathlon facility allows the inclusion of features not found in conjunction with triathlon events created from available bodies of water and roadways. For example, the body of water can be an artificial lake in the form of a donut, either round or elongated, with viewing stadiums within the inner periphery of the donut. The running track can cross over a part of the lake so that the finish line is within the Inner periphery of the lake, facilitating viewing of both the swim event and the running finish. The biking and running tracks can be constructed parallel to each other along at least a portion of their respective lengths to improve viewing. Permanent seating can be provided. Access to the event can be restricted, allowing the promoter to charge for admission to the event.

In the practice of the present invention, a permanent, compact, integrated facility is constructed that includes swimming, biking and running tracks in close proximity to each other, permanent stadium seating adjacent the tracks, and a fence or other access barrier with a controlled access gate surrounding the tracks and stadiums. The promoter then periodically schedules triathlon events at the facility and admits spectators to the facility upon payment of an access fee.

In summary, the present invention is directed to both an integrated triathlon complex having the features described above, and to a method of conducting triathlons events comprised of providing a facility having these features and staging events using the facility, while controlling access to the facility.

DETAILED DESCRIPTION OF THE INVENTION

In the practice of the invention, it will be apparent that each of the event areas, i.e., the areas for swimming, biking and running, may be laid out in different ways and that the areas may be arranged in different patterns relative to each other. In addition, the other facilities, some of which are optional, may be positioned at different locations relative to each other and to the event areas. All such complex designs are within the scope of the invention.

Figure 1:
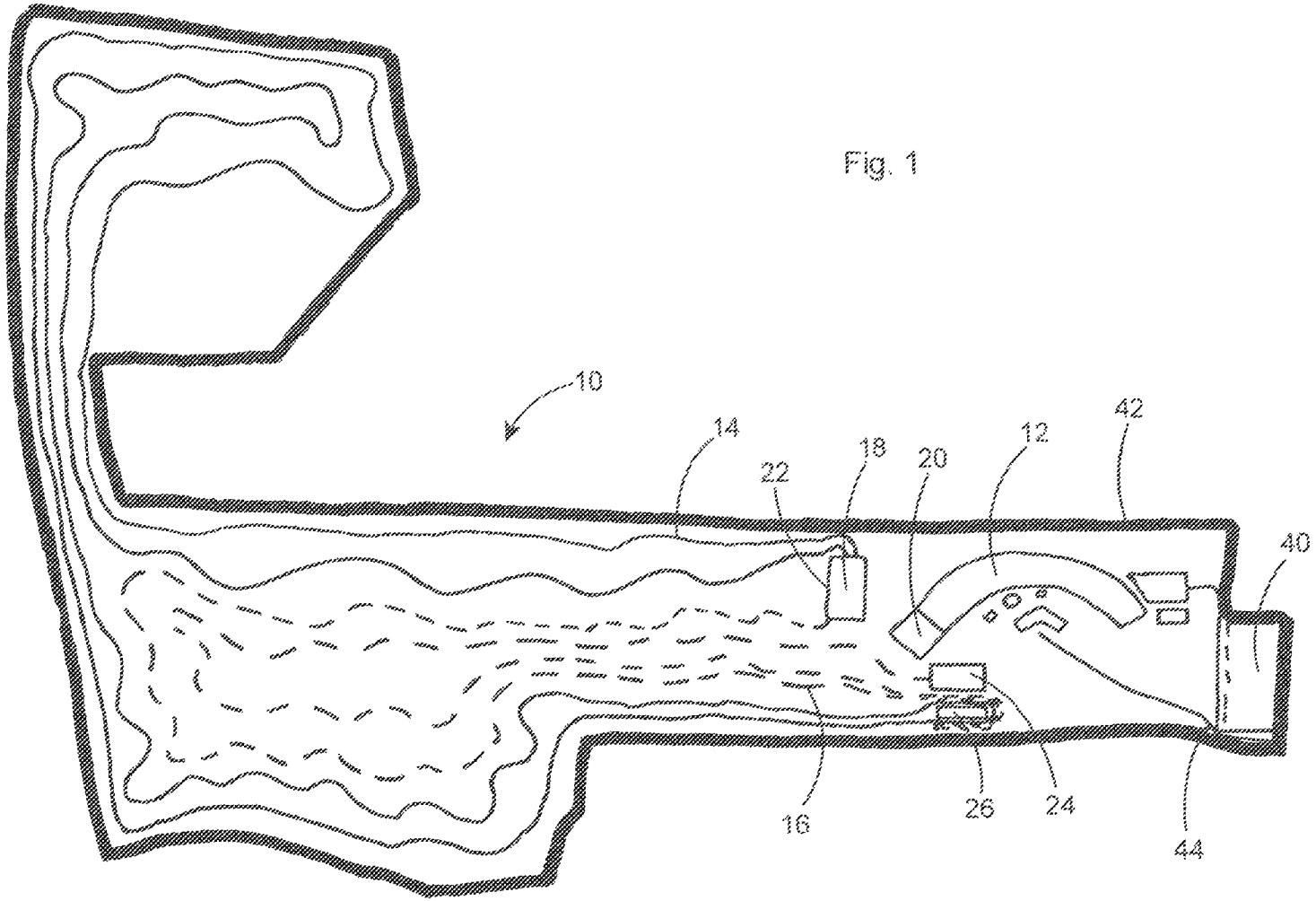
FIG. 1 is an overhead schematic of one embodiment of the triathlon complex.
Figure 2:
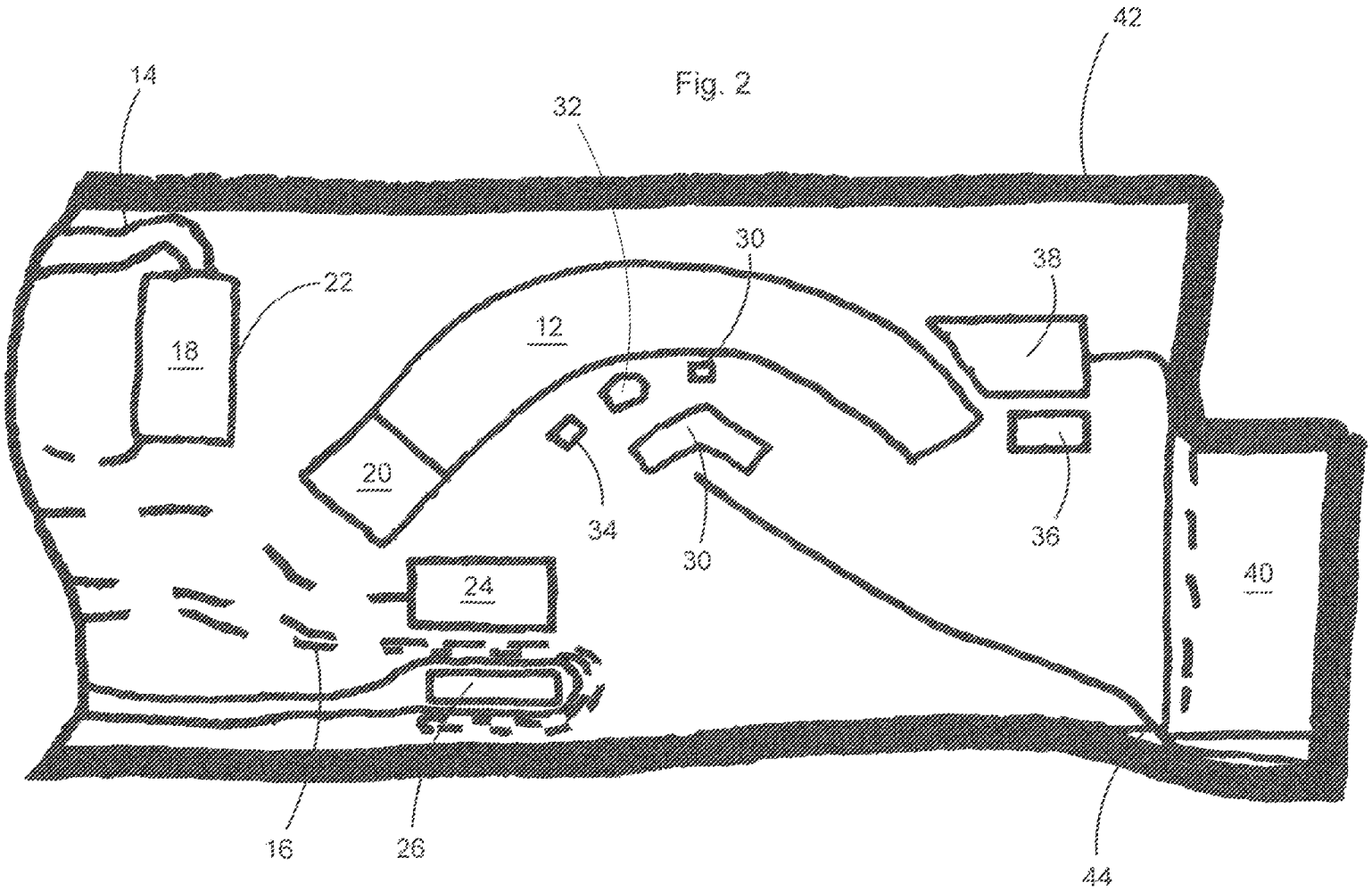
FIG. 2 an enlarged view of the right hand side of FIG. 1.

As illustrated in the FIGS. 1 and 2, a typical integrated triathlon complex, generally 10, will include a body of water, e.g., an artificial lake 12 that is at least 400 meters long and 100 meters wide. The body of water preferably includes a neutral zone in the center that has spaced lifeguard stations. Permanent lane ropes assist with direction and safety. Entry and exit points, which may be the same, are included in the layout.

The bike course 14 is a paved race track with lightly banked turns. The track has a width of at least 14 feet and a length of at least 7 miles. Preferably, the track has no corners. Start and finish lines, which may be the same, are included in the layout.

The running loop 16 is at least 3 miles long and at least 8 feet wide and is paved. Permanent run-through aid station gazebos are positioned along the loop. The running loop includes a starting point and a finish line.

A transition area 18 is located between the swimming area exit point and the bike course start point where the athletes collect their bikes from permanent, individually assigned racks. Transition area 18 may also be used for the athletes to leave their bikes and begin the running segment of the triathlon event. Preferably, the transition area is carpeted.

Unlike conventional triathlon events where viewer observation areas are limited both in locale and seating capacity, the complex of the present invention provides permanent stadium seating at critical locations, improving viewer participation and revenues to the operator. These locations include a swim stadium 20 at the start/finish area of the swim event, a transition stadium 22 where the audience can view the athletes as they transition from swimming to biking and biking to running, and a finish stadium 24 at the end of the triathlon, i.e., at the finish line of the running event. Other stadiums may be located at other positions along the event course where there is good viewing, e.g., at hairpin stadium 26 where both the running and biking tracks circle the stadium.

The integrated triathlon complex may also include other facilities to enhance the enjoyment of the athletes and spectators, and increase the revenues or the complex operator. These additional facilities may include a stage and amphitheater 30, a shopping area 32, a pavilion 34, rental cabins 36 and a mobile home park 38. Close in parking 40 is also available. The entire complex is surrounded by a barrier boundary 42 limiting access except through entry gate 44.

Figure 3:
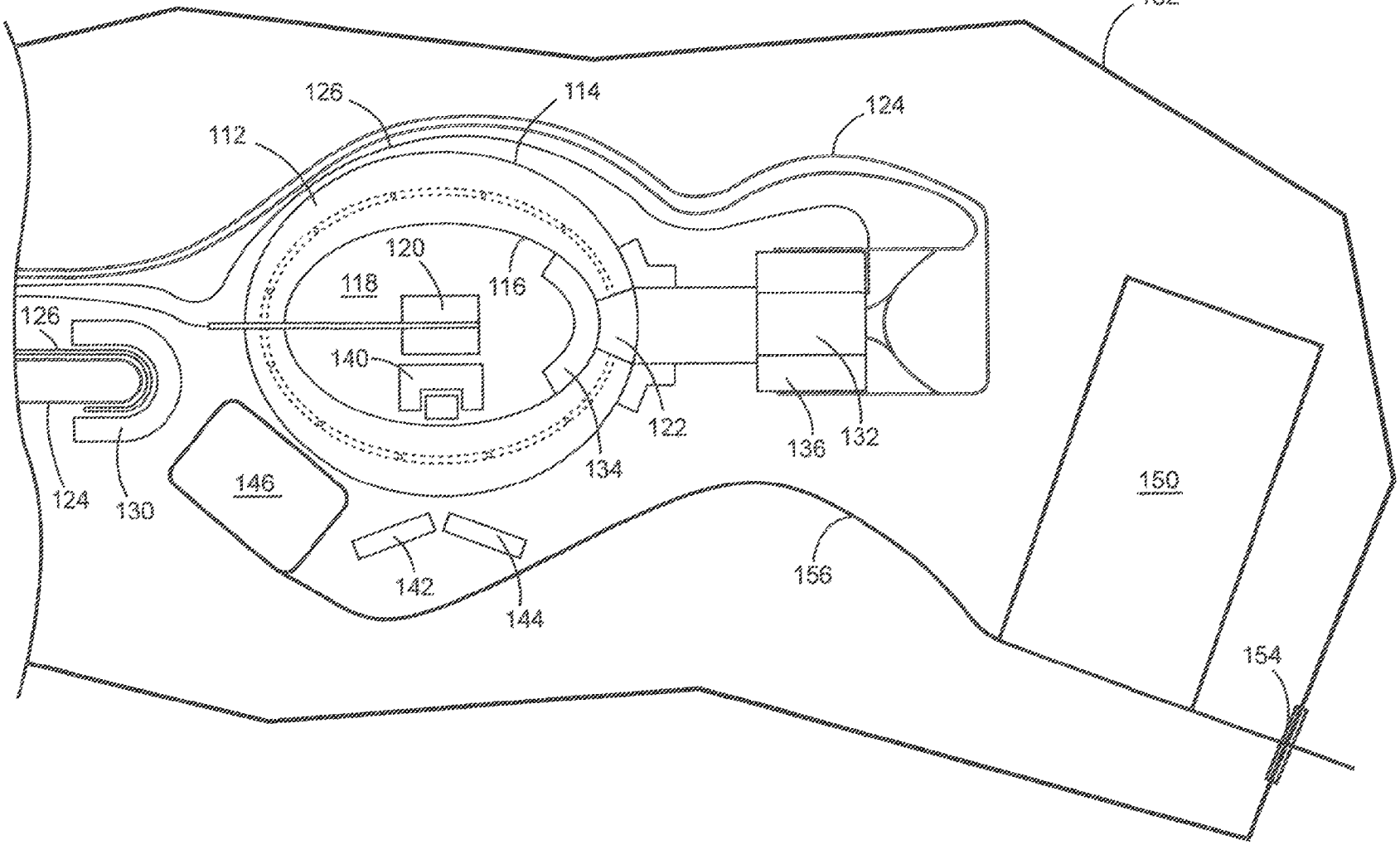
FIG. 3 is an overhead schematic of another embodiment of the triathlon complex.

Another embodiment of the invention is illustrated in FIG. 3. A segment of the running and biking tracks are cut away, and enhancements such as sidewalks are not illustrated to better illustrate the novel features of the invention. The illustrated integrated triathlon complex, generally 110, includes body of water, e.g., an artificial lake 112. Preferably, the body of water is an oval annulus, i.e., an elongated donut shape, with a continuous outer periphery 114 and a continuous inner periphery 116. Inner periphery 116 surrounds a stadium area 118 that includes finish line stadium 120. A common entry and exit point 122 is at one end of the oval.

Bike course 124 and running loop 126 are adjacent each other along a part of their lengths and are adjacent lake 112, improving viewing of the event. Course 124 and loop 126 also run parallel to each other around a hairpin turn, which includes hairpin stadium 130. The final segment of running 126 crosses over lake 112 and terminates at a finish line within finish stadium 120.

Transition area 132 is located between the exit point of the swimming course and the starting point of biking track 124 where the athletes collect their bikes from permanent, individually assigned racks. Transition area 132 is also used for the athletes to leave their bikes and begin the running segment of the triathlon event.

Unlike conventional triathlon events where viewer observation areas are limited both in locale and seating capacity, the complex of the present invention provides permanent stadium seating at critical locations, improving viewer participation and revenues to the operator. These locations include a swim stadium 134 at the start/finish area of the swim event, a transition stadium 136 where the audience can view the athletes as they transition from swimming to biking and biking to running, and a finish stadium 120 at the end of the triathlon, i.e., at the finish line of the running event within inner periphery 116 of lake 112. Other stadiums may be located at other positions along the event course where there is good viewing, e.g., at hairpin stadium 130 where both the running and biking tracks circle inside stadium 130.

The integrated triathlon complex may also include other facilities to enhance the enjoyment of the athletes and spectators, and increase the revenues of the complex operator. These additional facilities may include a stage and amphitheater 140, a lodge 142, a conference center 144, and a mobile home park 146. Close in parking 150 is also available. The entire complex is surrounded by a barrier boundary 152, e.g., a fence, limiting access except through entry gate 154 where admission to the event can be charged. Roadway 156 extends through gate 154 into the complex.

Certain modifications and improvements will occur to those skilled in the art upon a reading of the foregoing description. It should be understood that all such modifications and improvements have been deleted herein for the sake of conciseness and readability but are properly within the scope of the following claims.

What is claimed:

1. A self-contained, controlled access, triathlon complex comprising:

a) a dedicated artificial body of water having a swimming starting point and a swimming finish point;

b) a dedicated biking roadway having a biking starting point adjacent said swimming finish point, and a biking finish point;

c) a transition area between said swimming finish point and said biking starting point;

d) a dedicated running path having a running starting point adjacent said biking finish point, and a running finish point;

e) an access limiting boundary surrounding said body of water, biking roadway and running path, said boundary including at least one gate for allowing controlled access into said complex; and f) a transition stadium adjacent said transition area.

2. The complex of claim 1, wherein said body of water is at least 400 meters long.

3. The complex of claim 1, wherein said biking roadway is at least 7 miles long.

4. The complex of claim 1, wherein said running path is at least 3 miles long.

5. The complex of claim 1, further including permanent spectator seating.

6. A self-contained, controlled access, triathlon complex comprising:

a) a dedicated artificial body of water having a continuous outer periphery, a continuous inner periphery, and a swimming exit point;

b) a transition area adjacent said swimming exit point, and a transition stadium adjacent said transition area;

c) a dedicated biking roadway beginning and ending at said transition area;

d) a dedicated running path having a miming starting point at said transition area; and e) an access limiting boundary surrounding said body of water, biking roadway and running path, said boundary including at least one gate for allowing controlled access into said complex.

7. The triathlon complex of claim 6, further including a spectator stadium within the inner periphery of said body of water.

8. The triathlon complex of claim 6, further wherein said biking roadway and running path have a common hairpin turn.

9. The triathlon complex of claim 8, further including a hairpin stadium adjacent said hairpin turn.

10. The triathlon complex of claim 6, including a finish line, said running path including a running finish point at said finish line.

11. The triathlon complex of claim 10, wherein said finish line is within the inner periphery of said body of water.

12. The triathlon complex of claim 10, further including a finish stadium adjacent said finish line.

13. The triathlon complex of claim 6, wherein said running path crosses over body said body of water.

* * * * *